United States Patent [19]

Hirabayashi

[11] Patent Number: 5,003,297

[45] Date of Patent: Mar. 26, 1991

[54] METHOD OF DETECTING FAILURE TO TIGHTEN SCREWS AGAINST WORKS AND DEVICE THEREFOR

[75] Inventor: Junzou Hirabayashi, Aichi, Japan

[73] Assignee: Kabushiki Kaisha Toshiba, Kanagawa, Japan

[21] Appl. No.: 505,238

[22] Filed: Apr. 4, 1990

[30] Foreign Application Priority Data

May 26, 1989 [JP] Japan ..... 1-134046

[51] Int. Cl.[5] ..... G08B 21/00

[52] U.S. Cl. ..... 340/680; 340/568; 340/626; 340/664; 340/674

[58] Field of Search ..... 340/540, 680, 664, 674, 340/568, 686, 687, 600, 825.65, 626, 666; 73/862.21-862.23, 761; 81/469; 29/407; 173/12; 364/551.02; 361/170

[56] References Cited

U.S. PATENT DOCUMENTS

| | | | |
|---|---|---|---|
| 4,134,486 | 1/1979 | Grone | 340/674 X |
| 4,294,110 | 10/1981 | Whitehouse | 73/862.23 |
| 4,317,112 | 2/1982 | Beier et al. | 340/568 |
| 4,571,696 | 2/1986 | Bitzer | 29/407 X |
| 4,603,329 | 7/1986 | Bangerter et al. | 340/674 X |
| 4,831,364 | 5/1989 | Shinohara et al. | 340/680 |

*Primary Examiner*—Glen R. Swann, III

*Assistant Examiner*—Thomas J. Mullen, Jr.

*Attorney, Agent, or Firm*—Philip M. Shaw, Jr.

[57] ABSTRACT

A method of detecting failure to tighten screws against works includes steps of detecting every screw tightening operation against a work after start of a screw tightening step, counting the number of times of the screw tightening operations detected in the previous step, detecting the completion of the screw tightening step, and comparing a counted value at the time of the completion of the screw tightening step with a predetermined value, thereby informing of a result of comparison. A device for carrying out this method includes a current relay responsive to a large load current during the tightening operation of an electric screwdriver in a screw tightening step, a presettable counter for counting the number of operations of the current relay for the purpose of counting the number of screw tightening operations, setting knobs operated for setting a desirable number of screws to be tightened, photoelectric switches for detecting completion of the screw tightening step for the work, and an alarming device for comparing a counter value obtained by the presettable counter and the value set by the knobs when a screw tightening work completion signal is generated by any one of the photoelectric switches. The alarming device includes a buzzer energized when counted value does not reach the preset value set at the presettable counter.

7 Claims, 5 Drawing Sheets

METHOD OF DETECTING FAILURE TO TIGHTEN SCREWS AGAINST WORKS AND DEVICE THEREFOR

BACKGROUND OF THE INVENTION

This invention relates to a method of detecting failure to tighten screws against works and a device therefor, suitable for preventing occurrence of failure to tighten the screws in working step for tightening the screws against the works.

In an assembly line for electrical equipments, for example, various parts are mounted on an electrical equipment body as work by means of screws in a plurality of working steps. Generally, a worker in charge for each step tightens the previously allotted number of screws against each electrical equipment body sequentially conveyed along the assembly line with a tool such as an electric screwdriver or pneumatic screwdriver.

Whether or not the screws are correctly tightened against each work depends upon the degree of skillfulness and carefulness of the worker. Accordingly, it is inevitable that the failure to tighten the screws occurs at a certain rate. Particularly, various types of one electrical equipment have recently been produced in a small number in order that a diversity of consumers' needs can be met. In such circumstances, the number of screws to be used differs from one type of the electrical equipment to another and positions where the screws are tightened are changed with design changes even in one type. Accordingly, contents of work in the screw tightening step are also changed at relatively short intervals. Consequently, the workers cannot sometimes cope with the changes in the work contents, which has caused frequent occurrence of failure to tighten the screws. Conventionally, the products are checked in a final inspection at the assembly line. However, the products are visually inspected, which inevitably causes oversight.

SUMMARY OF THE INVENTION

Therefore, an object of the present invention is to provide a method of detecting failure to tighten screws and a device therefor, wherein upon occurrence of failure to tighten screws against the works in a work step of tightening the screws against the works with a tool, the failure can be immediately informed.

In order to achieve the object, the invention provides a method of detecting failure to tighten screws against works, comprising a first step of detecting every screw tightening operation against a work with a screw tightening tool after start of a screw tightening step, a second step of counting the number of times of the screw tightening operations detected in the first step, a third step of detecting the completion of the screw tightening step, and a fourth step of comparing a counted value at the time of the completion of the screw tightening step with a predetermined value, thereby informing of a result of comparison.

The invention also provides a device for detecting failure to tighten screws against works, comprising means for confirming a period for which a work step for tightening a plurality of screws against a work with a screw tightening tool is executed, counting means for counting the number of times of screw tightening operations in the confirmed period, and means for comparing the result of the counting by the counting means with a predetermined value, thereby informing of a result of comparison.

The invention may also be practiced by a device for detecting failure to tighten screws against works, comprising first detection means for detecting every screw tightening operation against a work with a screw tightening tool after start of a screw tightening step, thereby generating status signals, counting means for sequentially receiving the status signals generated by the first detection means to thereby count the number of the status signals, second detection means for detecting completion of the screw tightening step, thereby generating a completion signal, comparison means for comparing a counted value obtained by the counting means at the time of generation of the completion signal by the second detection means with a predetermined value, and means for informing of the result of comparison by the comparison means.

In the case where N (natural number) screws are tightened against the work, "N" is selected as a set value corresponding to the number of screws. In the screw tightening step, the counting means automatically counts the number of operations of the tool for tightening the screws. When the counting result at the time of completion of the screw tightening step differs from the set value "N," an alarming operation is performed. More specifically, the counting result does not reach the set value "N" owing to occurrence of failure to tighten any screws in the work step in which N screws need to be tightened. Consequently, the alarming operation is automatically performed.

The screw tightening tool may preferably include an electric tool and the first detection means may preferably comprise a current detector generating the status signal when the value of a load current supplied to the electric tool for tightening the screws exceeds a predetermined value.

Furthermore, the screw tightening tool may include a pneumatic tool having an operation member allowing and disallowing compressed air to flow thereto and the first detection means may comply a switch generating the status signal in response to an operation of the operation member of the pneumatic tool.

The second detection means may preferably be disposed on the assembly line along which works against which the screws are tightened are conveyed and generate the completion signal when the work passes a predetermined position on the line.

Preferably, the second detection means may also comprise a support on which the work against which the screws are tightened is placed and a switching element mounted on the support for responding to the placement of the work on the support.

Preferably, the second detection means may further comprise a holding member for holding a tool for tightening the screws at a standby position and a switching element mounted on the holding member for responding to the detachment of the tool from the holding member.

Other objects of the present invention will become obvious upon an understanding of the illustrative embodiments about to be described or will be indicated in the appended claims, and various advantages not referred to herein will occur to one skilled in the art upon employment of the invention in practice.

DESCRIPTION OF THE PREFERRED EMBODIMENT

Figure 1:
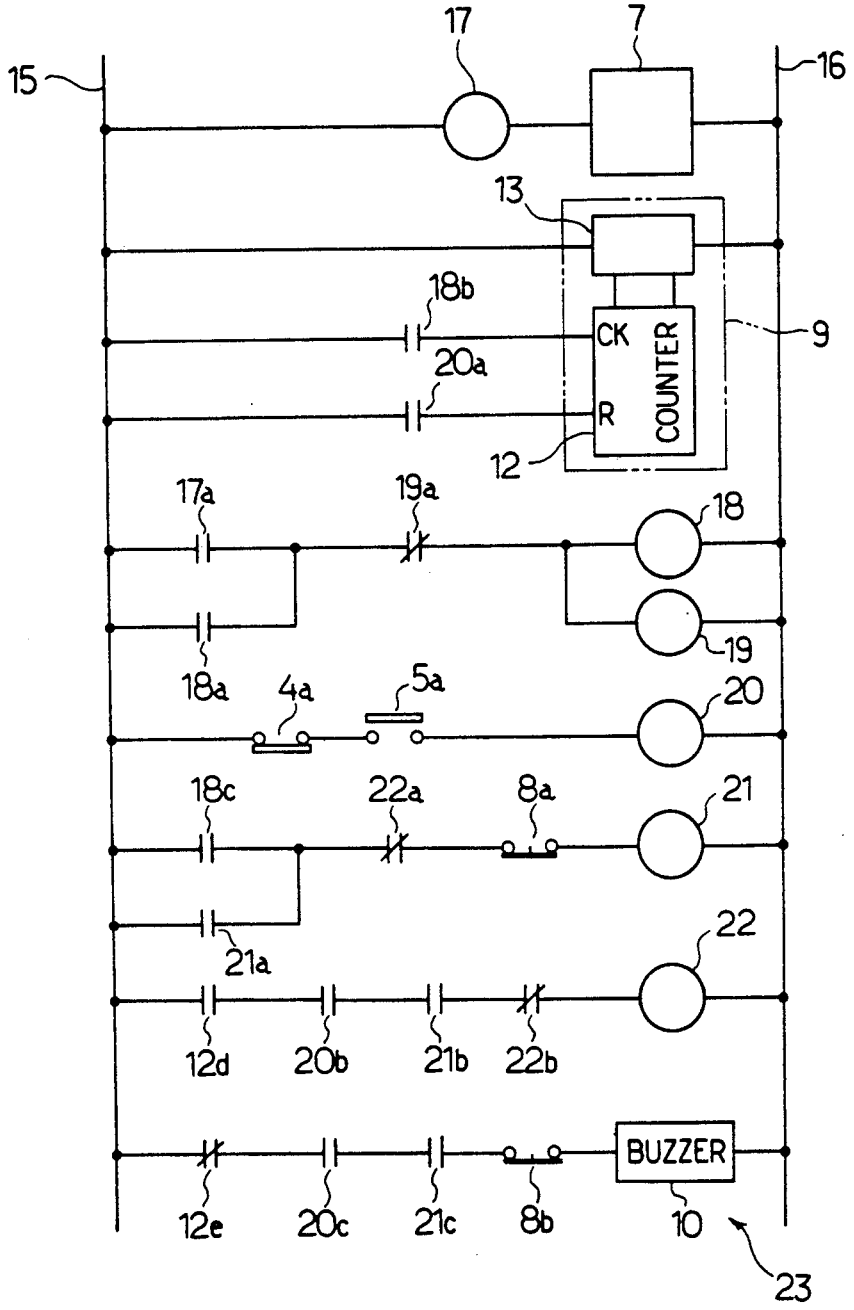
FIG. 1 is an electrical circuit diagram employed in a first embodiment of the invention.

A first embodiment of the present invention will now be described with reference to FIGS. 1 to 3(*a*)-3(*l*) of the accompanying drawings. Referring to FIG. 2, an assembly line 1 for electrical equipments such as microwave ovens is provided with a belt conveyor 2 driven at a predetermined speed. Works such as electrical equipment bodies 3 are sequentially conveyed by belt conveyor 2. For the purpose of confirming a period of a screw tightening work by detecting the completion of a screw tightening step, a displacement detecting device is provided at one of sides of belt conveyor 2 for detecting the displacement of electrical equipment body 3. The displacement detecting device comprises first and second reflection type photoelectric switches 4 and 5 disposed with a predetermined distance therebetween in the direction in which electrical equipment bodies 3 are sequentially conveyed on belt conveyor 2. The distance between photoelectric switches 4 and 5 is determined to be shorter than the dimension of electrical equipment body 3 in the direction in which it is conveyed on belt conveyor 2. Each of photoelectric switches 4 and 5 is of the built-in contact type. Photoelectric switch 4 disposed at the upper side has a normally closed sensor contact 4*a* (see FIG. 1) which is opened when electrical equipment body 3 being conveyed on the belt conveyor 2 is detected. Photoelectric switch 5 has a normally open sensor contact 5*a* (see FIG. 1) which is closed when electrical equipment body 3 is detected. Cables 4*b* and 5*b* for drawing outputs from contacts 4*a* and 5*a* are connected to photoelectric switches 4 and 5 at one ends and to plugs 4*c* and 5*c* at the other ends, respectively.

A detecting device body 6 is provided in the vicinity of belt conveyor 2 of assembly line 1. Detecting device body 6 is provided, at one side thereof, with jacks 4*d* and 5*d* to which plugs 4*c* and 5*c* are coupled. A door 6*a* is provided for closing the front opening of detecting device body 6. A twin plug socket 7, reset button 8 and counter unit 9 as counting means are mounted on the outer side of door 6*a* and an alarming buzzer 10 is mounted on the inner side thereof.

A power supply plug 11*a* of an electric screwdriver 11 as a tool for tightening screws is inserted into one of the plug sockets of twin plug socket 7. Electric screwdriver 11 comprises a body portion 11*b* which is held by a worker so that the worker performs the screw tightening job with screwdriver 11. A switch knob 11*c* of a power supply switch (not shown) is mounted on the body portion 11*b*. Knob 11*c* is operated so that power supply switch is closed, thereby driving an electric motor (not shown) provided within body portion 11*b*. Since twin plug socket 7 is employed, two electric screw drivers having different tightening torques may be used together. Two reset switches 8*a* and 8*b* (see FIG. 1) are mounted on the inner side of door 6*a* of detecting device body 6. Reset switches 8*a* and 8*b* are combined with reset button 8 such that both switches are opened when reset button 8 is depressed.

Figure 2:
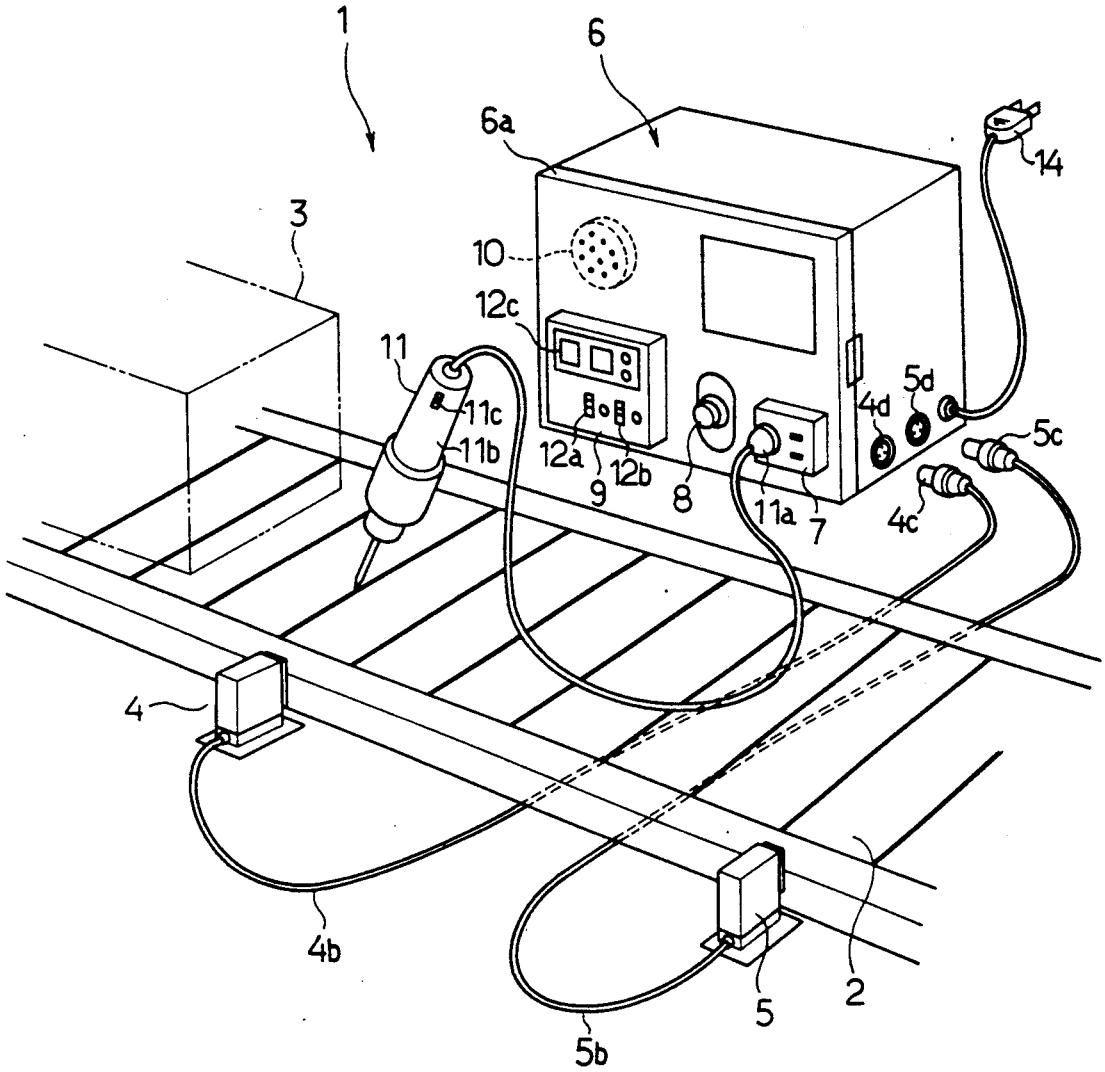
FIG. 2 a perspective view of a detecting device in accordance with the first embodiment.

Counter unit 9 comprises a presettable counter 12 and a power supply section (both shown in FIG. 1). Presettable counter 12 comprises setting knobs 12*a* and 12*b* for setting a two digit preset value Ns and a display 12*c* each digit of which is formed from seven segments each consisting of one light-emitting diode. Display 12*c* is externally operated to selectively display the digital preset value Ns or a digitized value Nr counted by counter 12. Detecting device body 6 is supplied with electrical power from a AC power source through a power supply plug 14.

Various control equipments such as a relay, current relay and timer are provided within alarming device body 6. The arrangement of a control circuit including these control equipments, counter unit 9 and so on will be described with reference to FIG. 1. A DC power (100 V, for example) is supplied through a pair of power supply lines 15 and 16 and plug 14. Plug socket 7 is connected to a current relay 17 as a current detector between power supply lines 15 and 16. Consequently, when plug 11*a* of electric screwdriver 11 is connected to plug socket 7, electric screwdriver 11 may be energized. Upon energization of electric screwdriver 11, a load current is caused to flow through current relay 17. Current relay 17 is provided for detecting a starting current as the load current flowing into the built-in motor of screwdriver 11. In the case where the motor of screwdriver 11 draws approximately 0.75 amps. at start-up, for example, current relay 17 is operated to close normally open relay switch 17*a* when a current of 0.5 amps. or more is drawn.

Counter unit 9 is connected between power supply lines 15 and 16. Counter 12 of the counter unit is adapted to count up one step every time a voltage signal is stepped down after the voltage signal is supplied to a clock terminal CK. Counter 12 is adapted to initialize the counted value when the voltage signal is supplied to a reset terminal R. Counter 12 has a normally open counter switch 12*d* and a normally closed counter switch 12*e*. When the counted value Nr reaches the preset value Ns, switch 12*d* is closed and switch 12*e* opened.

A first relay 18 is connected in series to a relay switch 17*a* of current relay 17 and a normally closed timer contact 19*a* of a timer 19 between power supply lines 15 and 16. First relay 18 has three normally open relay switches 18*a*, 18*b* and 18*c*. Relay switch 18*a* is connected in parallel with relay switch 17*a* of current relay 17. Relay switch 18*b* is connected between power supply line 15 and the clock terminal CK of counter 12. Timer 19 is connected in parallel with first relay 18. Timer 19 is adapted to open timer contact 19*a* thereof when energization thereof is continued for a predetermined period T (1.5 seconds, for example). Period T is set so as to be a little longer than a period necessary for tightening a screw with the screwdriver 11.

A second relay 20 is connected in series to sensor contacts 4*a* and 5*a* between power supply lines 15 and 16. Second relay 20 has three normally open relay switches 20a, 20b and 20c. Relay switch 12a is connected between power supply line 15 and the reset terminal R of counter 12.

A third relay 21 is connected in series to relay switch 18c of first relay 18, a normally closed relay switch 22a of a fourth relay 22 described later, and reset switch 8a between power supply lines 15 and 16. Relay 21 has three normally open relay switches 21a, 21b and 21c. Relay switch 21a is connected in parallel with relay switch 18c of first relay 18.

Fourth relay 22 has a normally closed relay switch 22b as well as relay switch 22a. Fourth relay switch 22 is connected in series to counter switch 12d of counter 12, relay switches 20b, 21b and 22b between power supply lines 15 and 16.

An alarm buzzer 10 is connected in series to counter switch 12e of counter 12, relay switches 20c and 21c and reset switch 8b between power supply lines 15 and 16, which series circuit constitutes an alarm circuit 23.

Operation of the above-described arrangement will now be described with reference to FIG. 4 as well as FIGS. 1 and 2. In the case where four screws are to be tightened against each work with electric screwdriver 11 in the screw tightening step, the preset value Ns of counter 12 is set at "4." Display 12c may be switched so as to display the preset value Ns for confirmation thereof and need be switched again so as to display the counted value Nr after confirmation.

When first reflection-type photoelectric switch 4 detects electrical equipment body 3 conveyed on the belt conveyor 2, sensor contact 4a of the photoelectric switch is opened, thereby detecting start of the screw tightening step. Subsequently, when electric screwdriver 11 is driven so that a first screw is tightened against a predetermined position of electrical equipment 3 (at time t1 in FIG. 3), a large starting current of approximately 0.7 amps. flows into built-in motor of screwdriver 11, thereby determining that the screw tightening operation has been performed. Upon detection of the starting current, current relay 17 causes relay switch 17a to be closed. Consequently, first relay 18 is energized with the result that relay switches 18a, 18b and 18c are closed (at time t2). In response to closure of relay switch 18a, first relay 18 is maintained in the self-holding state and timer 19 is continuously energized in response to the self-holding state of relay 18. Timer contact 19a is opened after timer 19 is energized for the predetermined period T, thereby releasing relay 18 from the self-holding state (at time t3). Consequently, since relay contact 18b is opened and then closed, that is, since the voltage applied to clock terminal CK of counter 12 is stepped down, counter 12 counts up one step at time t3 when relay switch 18b is opened. As described above, third relay 21 is energized to thereby close relay switches 21a, 21b and 21c at time t2 when relay switch 18c is closed. Third relay 21 is maintained in the self-holding state owing to closure of relay switch 21a.

Figure 3:
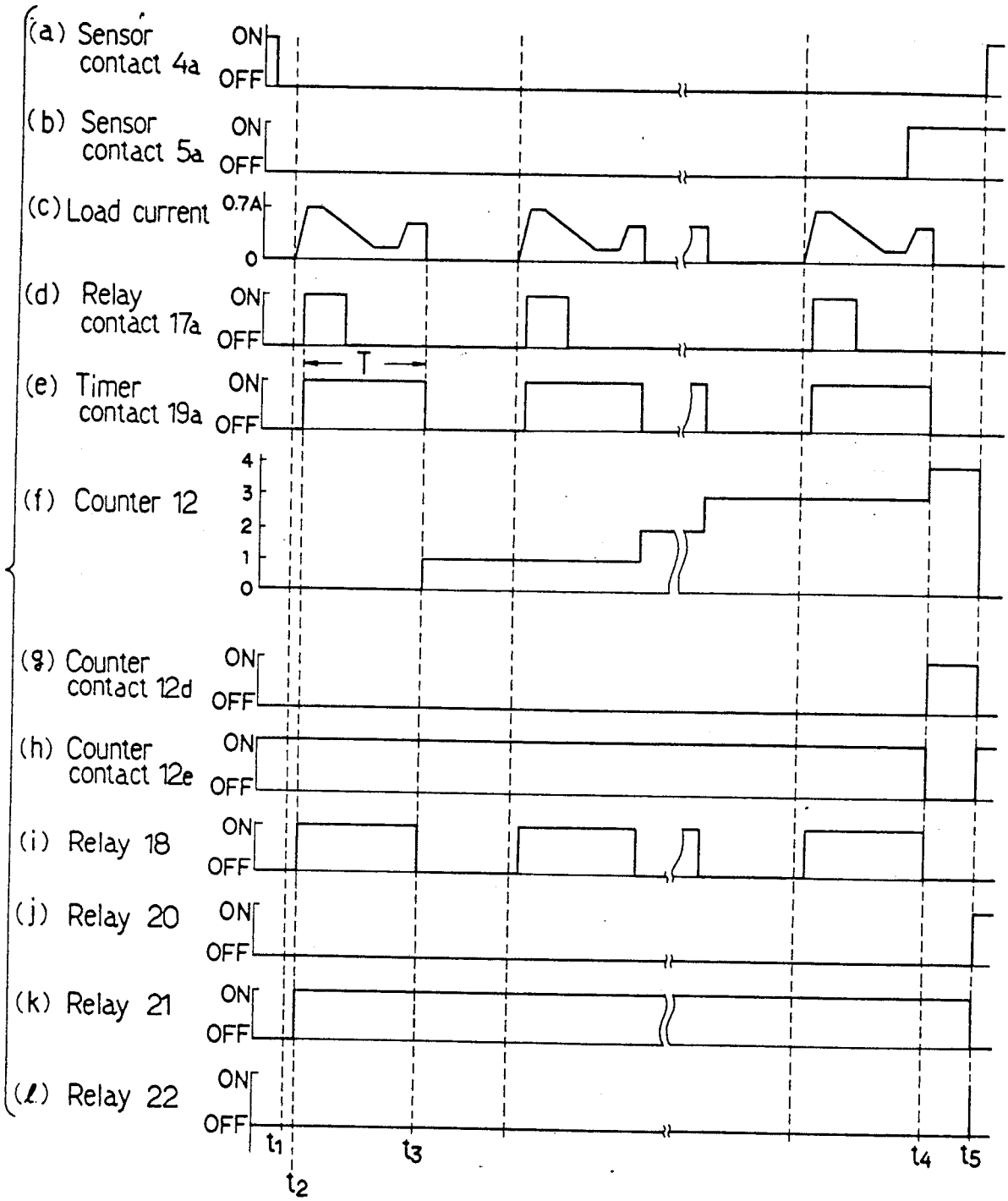
FIGS. 3(*a*) to 3(*l*) are time charts for explaining the operation of the detecting device.

When the screw is tightened against electrical equipment body 3 by electric screwdriver 11, the load current flowing into the motor of screwdriver 11 varies as shown in FIG. 3(*c*). More specifically, upon start of drive of screwdriver 11, the relatively large starting current of approximately 0.7 amps. temporally flows into the motor of screwdriver 11. Thereafter, when the screw tightening is completed, a lock current of approximately 0.5 amps. is drawn. Accordingly, relay switch 17a of current relay 17 the operative current of which is set at 0.5 amps. could be closed when the lock current is drawn. As a result, counter 12 counts up at the occurrence of the lock current and there is the possibility that the counted value Nr does not correspond to the number of screws tightened against the work. However, first relay 18 is maintained in the self-holding state such that counter 12 counts up by one step, until the period T set in timer 19 elapses, the period T being set so as to be a little longer than the period necessary for tightening one screw with the screwdriver. Consequently, the counted value Nr corresponds to the number of screws tightened with screwdriver 11.

Relay 18 is thus operated by timer 19 every time the screw tightening operation is executed. Counter 12 counts up by one step every time relay 18 is operated. When the counted value Nr of counter 12 reaches the preset value Ns or "4" or when the necessary number of screws are tightened, counter switch 12d is closed and counter switch 12e is opened (at time t4). On the other hand, electrical equipment body 3 is further conveyed on belt conveyor 2 and detected by second photoelectric switch 5. Sensor contact 5a of photoelectric switch 5 is closed to thereby detect the completion of the screw tightening step. Since the distance between photoelectric switches 4 and 5 is set so as to be shorter than the dimension of electrical equipment body 3 in the direction in which it is conveyed on belt conveyor 2, sensor contact 4a of first photoelectric switch 4 is still opened. When electrical equipment 3 is further conveyed on belt conveyor 2, sensor contact 4a of first photoelectric switch 4 is closed at time t5 corresponding to the time of completion of the screw tightening step. Then, both of sensor contacts 4a and 5a are closed and second relay 20 is energized, thereby closing relay switches 20a and 20b. Counter 12 is initialized when relay switch 20a is closed. Relay switch 21b of third relay 21 which is still in the self-holding state is in the on-state and counter switch 12d is closed. Consequently, fourth relay 22 is energized when relay switch 20b is closed. Then, since relay switches 22a and 22b are opened, third relay 21 is released from the self-holding state and second relay 22 is deenergized, thereby restoring the initial state. Since counter switch 12e is opened, alarm buzzer 10 is not energized even when relay switch 20c is closed, that is, alarm buzzer 10 is not driven when necessary four screws are tightened against electrical equipment 3, with the result that electrical equipment 3 is successively conveyed on belt conveyor 2.

On the contrary, when all the screws are not tightened against electrical equipment 3 by the worker's mistake, counter switch 12d remains open and counter switch 12e remains closed. Accordingly, even when relay switch 20b is closed in response to energization of second relay 20 at the time of completion of the screw tightening step or when sensor contact 4a is re-closed, fourth relay 22 is not energized with the result that third relay 21 is maintained in the self-holding state. Consequently, when relay switch 20c of second relay 20 is closed, alarm buzzer 10 is energized through counter switch 12e, relay switches 20c and 21c and reset switch 8b, thereby informing of the occurrence of failure in the screw tightening. Upon alarming operation of buzzer 10, the worker can tighten one or more screws which have not tightened. Upon the alarming operation, reset button 8 is depressed to open reset switches 8a and 8b, whereby third relay 21 is released from the self-holding state and alarm buzzer 10 is deenergized, thereby restoring the initial state.

According to the above-described embodiment, when all the screws are not tightened in the work step of tightening necessary number of screws against the electrical equipment 3, alarm buzzer 10 is immediately driven in the work step to thereby inform the worker of the occurrence of a failure. Consequently, such occurrence of the failure to tighten the screws against the electrical equipment 3 may safely be coped with. Furthermore, since the automatic execution of the alarming operation necessitates only the setting of the necessary number of screws as the preset value Ns in counter 12, the screw tightening efficiency is not reduced.

Figure 5:
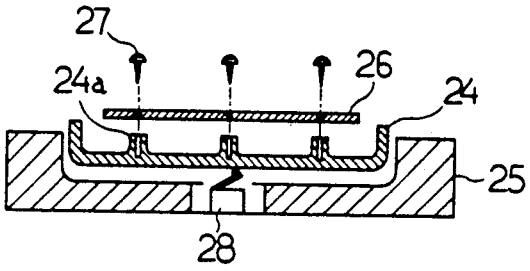
FIG. 5 is a longitudinal section of the major part of the detecting device in accordance with the second embodiment.
Figure 4:
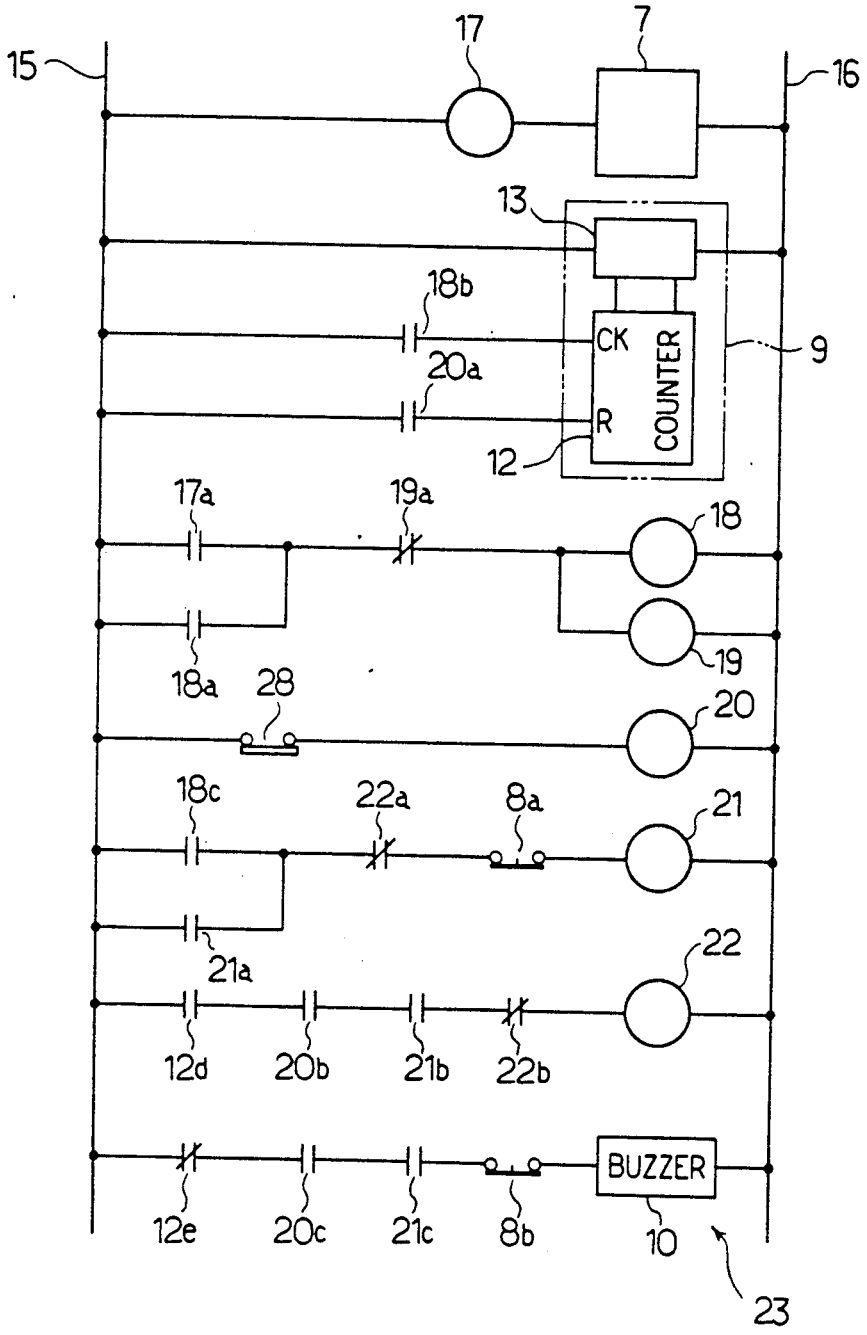
FIG. 4 is a view similar to FIG. 1 showing a second embodiment of the invention.

FIGS. 4 and 5 illustrate a second embodiment of the invention. Although the screws are tightened against the electrical equipments 3 conveyed on belt conveyor 2 in the foregoing embodiment, the invention may be applied to a screw tightening step in which jigs are employed. Referring to FIG. 5, an electrical equipment panel 24 as a work is placed on a holding jig 25. A plurality of boss portions 24*a* are formed in panel 24. A necessary number of screws 27 is engaged with boss portions 24*a* so that, for example, a printed wiring board 26 is secured. A normally closed limit switch 28 serving as means for generating a screw tightening completion signal is mounted on jig 25 for the purpose of confirming the period necessary for the screw tightening step. Limit switch 28 is opened when panel 24 is placed on jig 25.

Limit switch 28 is connected between power supply lines 4 and 5 through second relay 20 within alarming device body 6, as shown in FIG. 4. Provision of limit switch 28 eliminates first and second photoelectric switches 4 and 5 from alarming device body 6 in the foregoing embodiment. Connection of limit switch 28 is made by means of jack 4*d* of detecting device body 6 and jack 5*d* is short-circuited by, for example, a plug adapter (not shown).

The predetermined number of screws 27 is set at counter 12 as the preset value Ns. In the condition that panel 24 is placed on jig 25, limit switch 28 is opened and accordingly, second relay 20 is deenergized. During deenergization of second relay 20, counter 12 counts up by one step every time one screw is tightened with electric screwdriver 11. When the necessary number of screws are tightened, counter switch 12*d* is closed and counter switch 12*e* is opened. Thereafter, when panel 24 is removed from jig 25 and limit switch 28 is closed, fourth relay 22 is energized through counter switch 12*d* and relay switches 20*b*, 21*b* and 22*b*. Consequently, alarm buzzer 10 is not driven. On the other hand, in the case that the necessary number of screws are not tightened against electrical equipment 3 by the worker's mistake or that counter contact 12*d* is opened and counter switch 12*e* is closed, fourth relay 22 is not energized even when panel 24 is removed from jig 25 and limit switch 28 is closed. Consequently, alarm buzzer 10 is energized to thereby inform the worker of the occurrence of failure to tighten screws.

Figure 6:
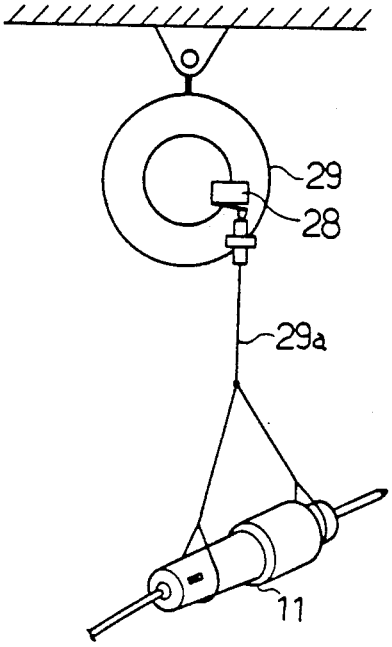
FIG. 6 is a perspective view of the major part of a third embodiment of the invention.
Figure 7:
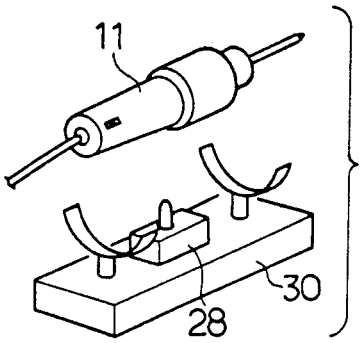
FIG. 7 is a perspective view of the major part of a fourth embodiment of the invention.

Although limit switch 28 is mounted on jig 25 for detecting completion of the screw tightening step, in the second embodiment, it may be mounted on a conventional reel disposed over the worker for holding electric screwdriver 11 at a standby position as shown in FIG. 6 as a third embodiment. Limit switch 28 is closed when a wire 29*a* suspending electric screwdriver 11 is taken up by reel 29 such that electric screwdriver 11 is lifted. Or, as illustrated in FIG. 7 as a fourth embodiment, limit switch 28 may be mounted on a stand 30 of electric screwdriver 11 disposed in the vicinity of the worker. Limit switch 28 is closed when electric screwdriver 11 is held on stand 30.

The system shown in FIGS. 1 and 2 may be further modified as a fifth embodiment. In order to tighten the screws against one work with a plurality of electric screwdrivers in a single screw tightening step, n number of electric screwdrivers 11 are provided. Between power supply lines 4 and 5 are connected two or more screw-tightening detecting circuits each including plug socket 7 and current relay 17 connected in the same manner as shown in FIG. 1 and two or more circuits each including relay 18, timer 19 and relay switches 17*a*, 18*a* and 19*a* connected in the same manner as shown in FIG. 1. Two or more relay switches 18*b* of relays 18 of circuits are connected in parallel with one another between power supply line 15 and clock terminal CK of counter unit 19. In the fifth embodiment, failure to tighten the screws may be detected and informed when a plurality of workers are engaged in the screw tightening work against one work.

Figure 8:
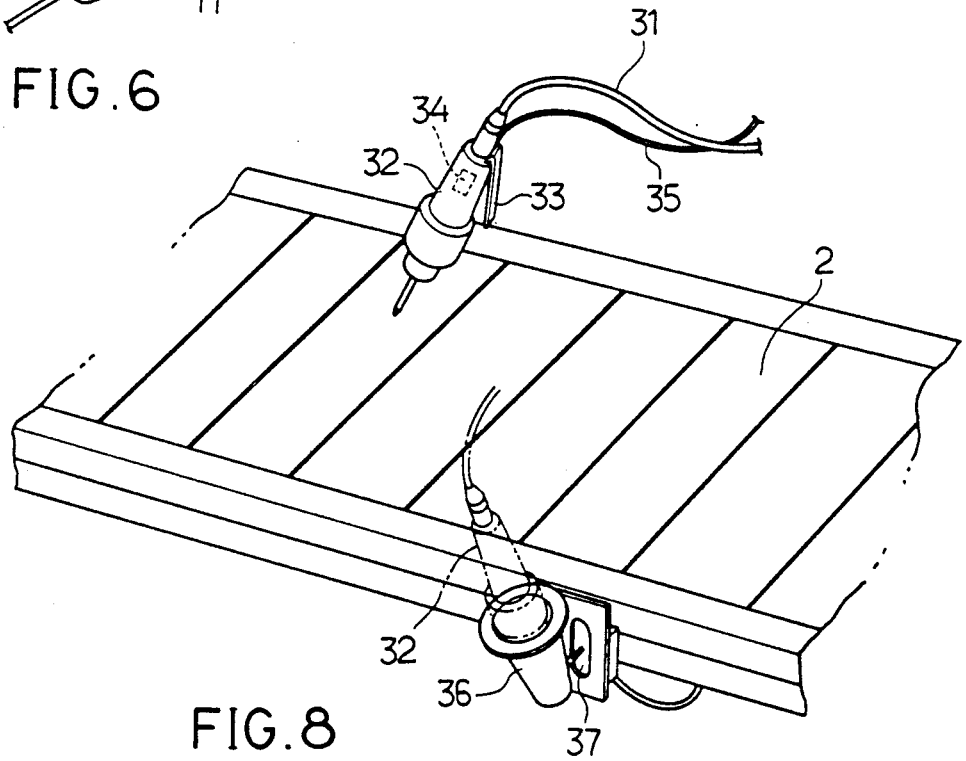
FIG. 8 is a perspective view of the detecting device in accordance with a sixth embodiment of the invention.

Referring to FIG. 8 illustrating a sixth embodiment, a pneumatic screwdriver 32 is provided as a screw tightening tool so as to be driven by compressed air supplied through a hose 31 communicated to a compressed air source (not shown). Pneumatic screwdriver 32 has a lever 33 for closing and opening a valve which allows and disallows compressed air to flow to pneumatic screwdriver 32 and a first switch 34 connected in series to a lead wire 35. First switch 34 is interlocked with lever 33. When lever 33 is gripped by the worker for the screw tightening, the valve is opened, thereby driving pneumatic screwdriver and turning a first switch on by way of lever 33. A holder 36 is provided over assembly line 2 for holding pneumatic screwdriver 32 with completion of the screw tightening step. Holder 36 is provided with a second switch 37 responsive to the weight of pneumatic screwdriver 32. A circuit arrangement wherein first switch 34 is employed instead of switch 17*a* and second switch 37 instead of switches 4*a* and 5*a* in FIG. 1 performs the same operation of detecting failure to tighten screws as the device shown in FIG. 1.

The foregoing disclosure and drawings are merely illustrative of the principles of the present invention and are not to be interpreted in a limiting sense. The only limitation is to be determined from the scope of the appended claims.

What I claim is:

1. A method of detecting a failure in tightening a predetermined number of screws with a screw tightening tool against a work having a plurality of portions into which the screws are tightened, the method comprising the steps of:

(a) generating an electrical signal every time a screw is tightened into each portion of one work with the screw tightening tool;

(b) electronically counting the signals generated within a predetermined working period of an operator engaged in the screw tightening such that a counted value is obtained;

(c) electronically comparing the counted value with a predetermined value representative of the predetermined number of screws after a lapse of the predetermined working period; and (d) electronically providing an indication to the worker as to whether the counted value is smaller than the predetermined value.

2. A method for detecting a failure in tightening screws against a work having a plurality of portions into which the screws are tightened, the device comprising:

(a) means for generating first and second signals at the times of the start and completion, respectively, of a screw tightening step carried out by an operator;

(b) detection means for generating an operation detection signal every time a screw is tightened at each portion of one work with a screw tightening tool;

(c) means for setting a predetermined value representative of the number of the portions of the work into which the screws are to be tightened;

(d) counter means for automatically counting the operation detection means sequentially generated by the detection means for a period between the generation of the first signal and the generation of the second signal;

(e) comparison means for electronically comparing a counter value obtained by the count means with the predetermined value and producing a comparison result signal, and (f) means supplied with the comparison result signal for informing the worker to whether or not the counter value is smaller than the predetermined value.

3. A device according to claim 2, wherein the screw tightening tool includes an electrically driven tool and the detection means comprises a detection device for generating the operation detection signal when a load current supplied to the electrically driven tool exceeds a predetermined value.

4. A device according to claim 2, wherein the screw tightening tool includes a pneumatically driven tool having a manually operated member allowing and disallowing compressed air to be supplied thereto and the detection means comprises a switch for generating the operation detection signal in response to operation of the manually operated member of the pneumatically driven tool.

5. A device according to claim 2, wherein the first and second signal generating means comprises first and second position detecting devices disposed on a line along with the works against which the screws are tightened are conveyed, with a predetermined distance therebetween in the direction in which the works are conveyed along the line and the first and second position detecting devices detect the work passing the respective first and second positions on the line, thereby generating the respective first and second signals.

6. A device according to claim 2, wherein the first and second signal generating means comprises a support on which the work is placed and a switch element, provided on the support, for generating the first signal in response to the placement of the work on the support and the second signal in response to the removal of the work from the support.

7. A device according to claim 2, wherein the first and second signal generating means comprises a holding member for holding the screw tightening tool at a non-operating position and a switch provided on the holding member for generating the second signal when the screw tightening tool is held by the holding member and the first signal when the screw tightening tool is removed from the holding member.

* * * * *